US005461874A

United States Patent [19]

Thompson

[11] Patent Number: 5,461,874

[45] Date of Patent: Oct. 31, 1995

[54] METHOD AND APPARATUS FOR TRANSPORTING MATERIAL

[76] Inventor: Michael C. Thompson, 520 S. Ridge St., Southern Pines, N.C. 28387

[21] Appl. No.: 163,892

[22] Filed: Dec. 7, 1993

[51] Int. Cl.[6] ..... F25C 1/00

[52] U.S. Cl. ..... 62/60; 62/66; 62/356

[58] Field of Search ..... 62/356, 60, 66, 62/340, 356

[56] References Cited

U.S. PATENT DOCUMENTS

| | | | |
|---|---|---|---|
| 1,771,151 | 7/1930 | Treichel . | |
| 2,248,270 | 7/1941 | Geertz . | |
| 2,853,139 | 9/1958 | Biro . | |
| 2,857,005 | 10/1958 | Medlock . | |
| 2,929,221 | 3/1960 | Clauson | 62/66 X |
| 3,529,670 | 9/1970 | Herbline . | |
| 3,864,935 | 2/1975 | Elson . | |
| 3,886,972 | 6/1975 | Scott et al. . | |
| 3,892,252 | 7/1975 | Poettmann . | |
| 3,906,972 | 9/1975 | Jensen et al. . | |
| 4,047,539 | 9/1977 | Kruka . | |
| 4,121,431 | 10/1978 | Meudec et al. | 62/66 |
| 4,715,803 | 12/1987 | Koppa . | |
| 4,846,648 | 7/1989 | Spence et al. . | |
| 5,096,646 | 3/1992 | Shigemoto et al. . | |
| 5,125,819 | 6/1992 | Hager et al. . | |
| 5,193,942 | 3/1993 | Berry et al. . | |

FOREIGN PATENT DOCUMENTS

| | | |
|---|---|---|
| 776616 | 1/1980 | U.S.S.R. . |
| 1257228 | 9/1986 | U.S.S.R. . |
| 1362484 | 12/1987 | U.S.S.R. . |

*Primary Examiner*—William E. Tapoical
*Attorney, Agent, or Firm*—John B. Phillips; John R. Ley

[57] ABSTRACT

A method of transporting material includes forming a structural encasement from the material and applying a force to the encasement to transport the material to a desired destination. The structural encasement allows for the transmission of applied forces through the encasement. A core material may be encased within the structural encasement so that both materials are transported together. Confinement forces are transmitted throughout the structural encasement to maintain the core material encased within the encasement. A preferred apparatus for practicing the method includes an inner nozzle for projecting core material and an outer nozzle surrounding the inner nozzle for projecting a hollow column of encasement material around the core material so that the core material is encased within the column. The outer nozzle further applies force to the column to direct the column and the encased core material to the desired destination. The column and the core material may constitute either the same or dissimilar materials and may be projected from the apparatus at either the same or different velocities.

17 Claims, 5 Drawing Sheets

METHOD AND APPARATUS FOR TRANSPORTING MATERIAL

FIELD OF THE INVENTION

The present invention relates generally to projection or transportation of material, and more particularly to a method and apparatus for structurally encasing a first material within a second material for controlled transport of both materials.

BACKGROUND OF THE INVENTION

Current methods of transporting or projecting material, particularly non-solid material, typically include applying a force by pressurizing the material and projecting it toward a desired location. Such material is frequently transported directly through the air or a pipeline, although the material may occasionally be transported through other environments including, but not limited to, solid (but penetrable) matter or a vacuum. One problem with transporting material in this manner is the inability to control the dimensional stability of the material while it is en route to its destination. Another problem is that the surrounding environment may contaminate the material or impart forces such as friction to the material which tend to dissipate the material or hinder its progress.

These problems may be illustrated by a fire nozzle which must project a water stream through the air to a fire scene. As the water stream leaves the nozzle, it is under pressure and exerts some component of force in all directions. The pressurized water stream tends to expand radially and dissipate since no confining force exists to hold the water stream together. The dissipation of the unconfined water stream may prevent the stream from reaching its intended destination. If the distance covered by the water stream along its trajectory is found to be inadequate, it cannot be significantly increased by simply increasing the pressure force at the nozzle, as this force cannot be fully transmitted through the unconfined water stream. Additionally, control of the water stream that has already left the nozzle is not possible because forces applied at the nozzle cannot be transmitted through the unconfined stream.

In summary, the trajectory of an unconfined water stream is determined solely by the inertia imparted to the water at the nozzle. No forces applied at the point of projection can be transferred through the unconfined water stream to alter the trajectory of the stream. Furthermore, an unconfined water stream is subject to dissipation due to internal forces, and to friction and contamination from the environment through which it is transported.

Although a fire nozzle and a water stream have been used to illustrate several problems of conventional material transfer, any transportable material (e.g. liquids, gases, slurries, granular solids, etc.) may react unfavorably with the environment through which it passes. Even if a material stream is transported through a vacuum, it will tend to dissipate due to the unconfined internal pressure within the stream.

Some of these problems may be addressed by transporting a material stream through a pipeline. A pipeline prevents a pressurized stream from dissipating and can prevent the environment outside the pipeline from contaminating the material. Additionally, there is usually no need to alter the direction of a material transported within a fixed pipeline. However, material transported within a pipeline is subject to frictional forces and consequent turbulence due to contact with the inside of the pipe wall. Friction reduces the velocity of the material to zero at the pipe wall, thereby reducing the flow of material through the pipeline, and heats both the transported material and the pipeline itself. Thus, pumping energy must be increased (by an amount equal to the energy lost to friction) to maintain the flow through the pipeline. Furthermore, pipelines are typically immobile and often require lengthy construction periods, thus making pipelines an impractical solution for short term material transfer.

It is against this background that significant improvements and advancements have evolved in the field of material transport.

SUMMARY OF THE INVENTION

The present invention is embodied in a method and apparatus for transporting material. The method includes forming a structural encasement from the material and applying a force to the encasement to transport the material to a desired destination. The structural encasement allows for the transmission of applied forces through the encasement. Additionally, a further step of mixing a core material with the structural encasement may be included so that both materials are transported together. Alternatively, a transportable core material may be projected into a cavity defined in the structural encasement, wherein confinement forces are transmitted throughout the structural encasement to maintain the core material encased within the cavity.

A preferred embodiment of the method includes forming the structural encasement as a hollow column at a first point, projecting the column from the point toward the destination, and projecting the transportable core material into the cavity of the hollow column at the first point so that the core material is encased within the column. The column and the core material may constitute either the same or dissimilar materials. Additionally, the column and the core material may be projected at either the same or different velocities. Furthermore, a variety of methods may be used to project the column, including a single continuous projection as well as a series of modular projections of both the encasement and the core material.

An apparatus for practicing the preferred embodiment of the method includes an inner nozzle for projecting core material, and an outer nozzle surrounding the inner nozzle for projecting a hollow column of encasement material around the core material so that the core material is encased within the column. The outer nozzle further applies force to the column to direct the column and the encased core material to the desired destination.

A preferred embodiment of the apparatus utilizes supercooled water to project an ice column about the core material. The ice column is generated in the area between the inner and outer nozzles by mixing the supercooled water with crystallization trigger particles. These particles enhance the formation of an ice lattice as the supercooled water is projected toward a muzzle of the apparatus. When projected with sufficient force (i.e. when the supercooled water and the core material are initially pressurized to a sufficient degree), modular units of the ice column and the encased core material may be launched ballistically toward the destination. Alternatively, the apparatus may project the ice as a continuous column toward the desired destination and then project the core material through the hollow interior of the ice column.

Regardless of the manner in which the encasement and the core material are projected, the preferred method and apparatus of the present invention find particular utility in transporting fire-extinguishing materials to a fire scene. In particular, the method and apparatus may be used to project an ice column and an encased core material to a fire scene, whereby the ice column absorbs heat from the fire and wherein the core material comprises chilled water, a fire-fighting foam or another type of transportable fire suppressant.

A more complete appreciation of the present invention and its scope can be obtained from understanding the accompanying drawing, which is briefly summarized below, the following detailed description of presently preferred embodiments of the invention, and the appended claims.

DETAILED DESCRIPTION OF THE PREFERRED EMBODIMENTS

Figure 1:
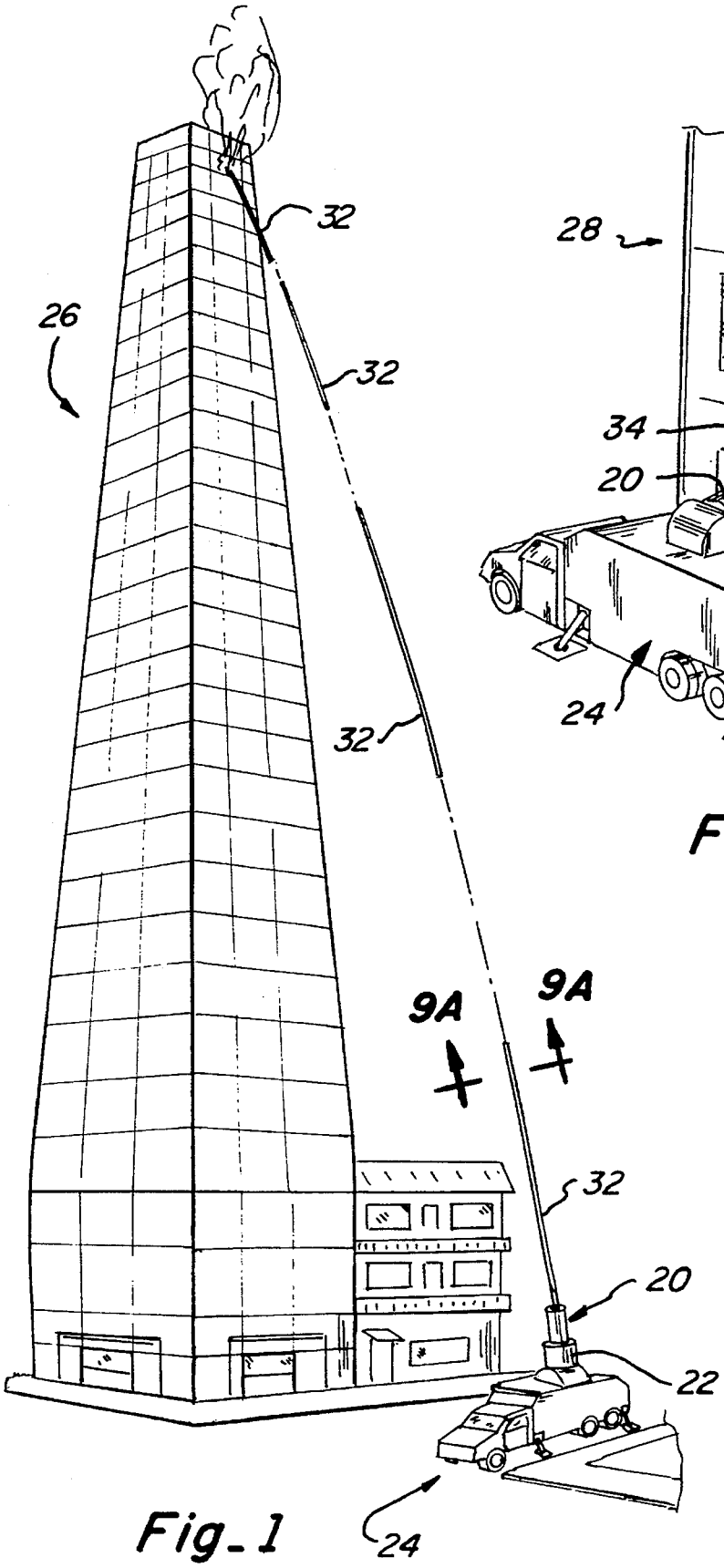
FIG. 1 is a perspective view of an apparatus embodying the present invention, showing the apparatus extinguishing a fire in a high rise building.
Figure 2:
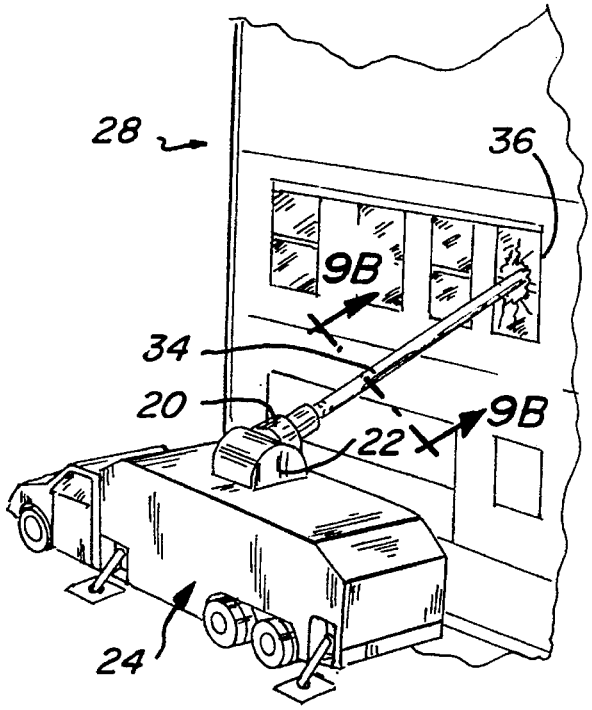
FIG. 2 is a perspective view of the apparatus illustrated in FIG. 1, showing the apparatus extinguishing a chemical fire in a warehouse.

FIGS. 1–4 show an apparatus 20 (hereinafter referred to as an "ice gun") embodying the present invention. In FIGS. 1 and 2, the ice gun 20 is mounted on a steerable turret 22 atop a fire truck 24 and is used to extinguish two separate types of fires. FIG. 1 illustrates a fire in a high-rise building 26, while FIG. 2 illustrates a hazardous material fire such as in a chemical warehouse 28.

In FIG. 1, the ice gun 20 projects individual cores of chilled water 30 encased within independent hollow columns or tubes 32 of ice at predetermined intervals and with sufficient inertia to reach the fire scene hundreds of feet above the ice gun 20. Thus, the ice columns 32 shown in FIG. 1 and the encapsulated water cores 30 are projected from the ice gun 20 at the same velocity so that the water cores 30 remain encased in the ice columns 32 along their entire trajectory. Upon impact with the structure 26, the ice encasement shatters and releases the water core 30.

In FIG. 2, the fire truck 24 is positioned close to the fire scene and the ice gun 20 forms and extends a hollow column or tube 34 of ice through a window 36 or other opening in the building 28 so that a free end (not shown) of the column is positioned adjacent to the fire. The hollow ice column 34 is formed and projected from the ice gun 20 with a relatively slow velocity which is just sufficient to replenish at a proximal end of the column 34 the ice that is melted by the fire at the free or distal end of the column. A core material 38 such as a fire suppressant foam is projected through the hollow ice column 34 and applied to the fire scene. Thus, the core material 38 is projected from the ice gun 20 at a greater velocity than the velocity at which the ice column 34 is formed. In this manner, the cantilevered ice column 34 provides a temporary conduit or extension which allows for the precise application of the core material 38 at minimum risk to fire fighters operating the ice gun 20.

Figure 3:
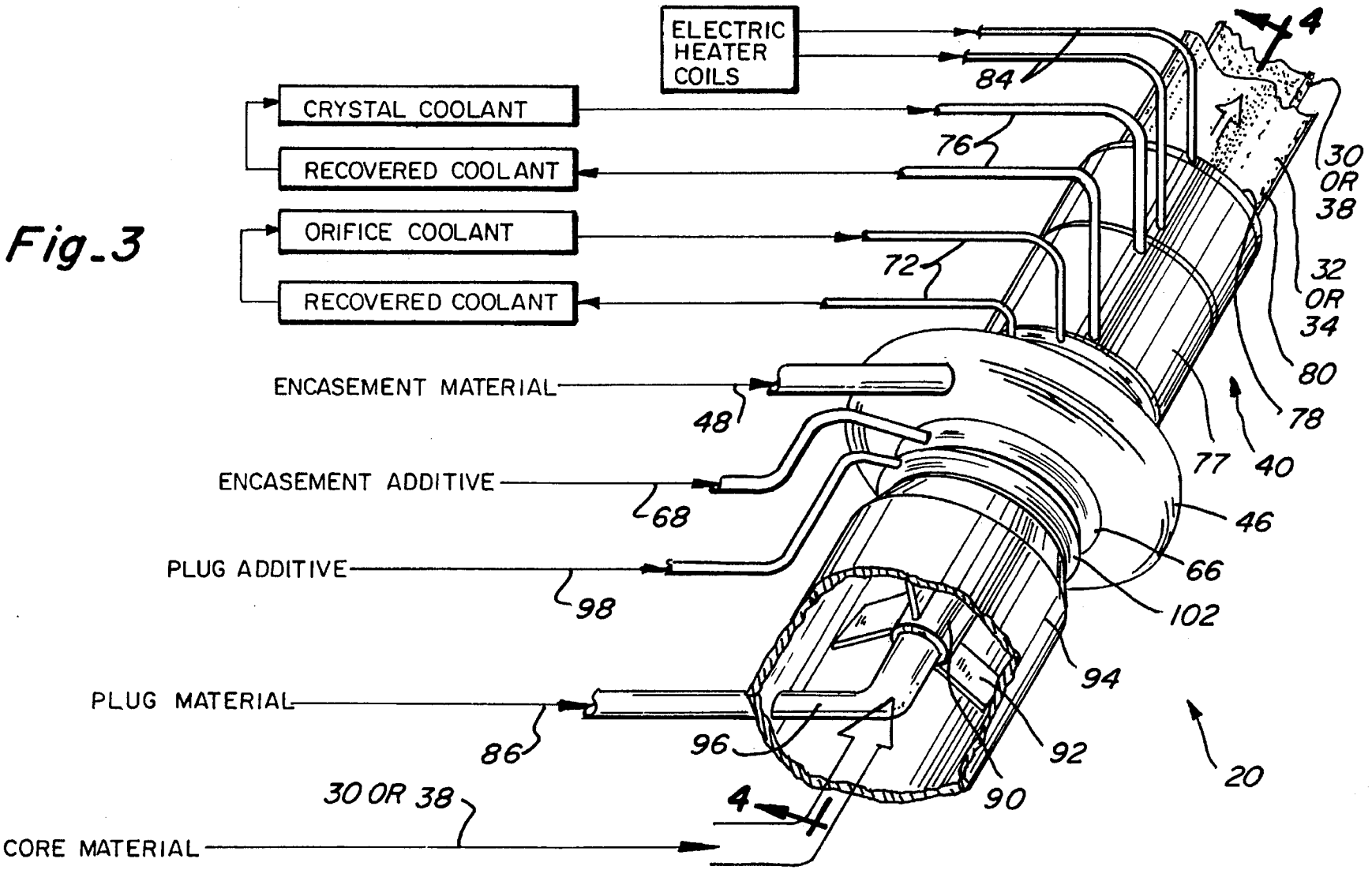
FIG. 3 is an enlarged isometric block diagram of the apparatus illustrated in FIGS. 1 and 2.
Figure 4:
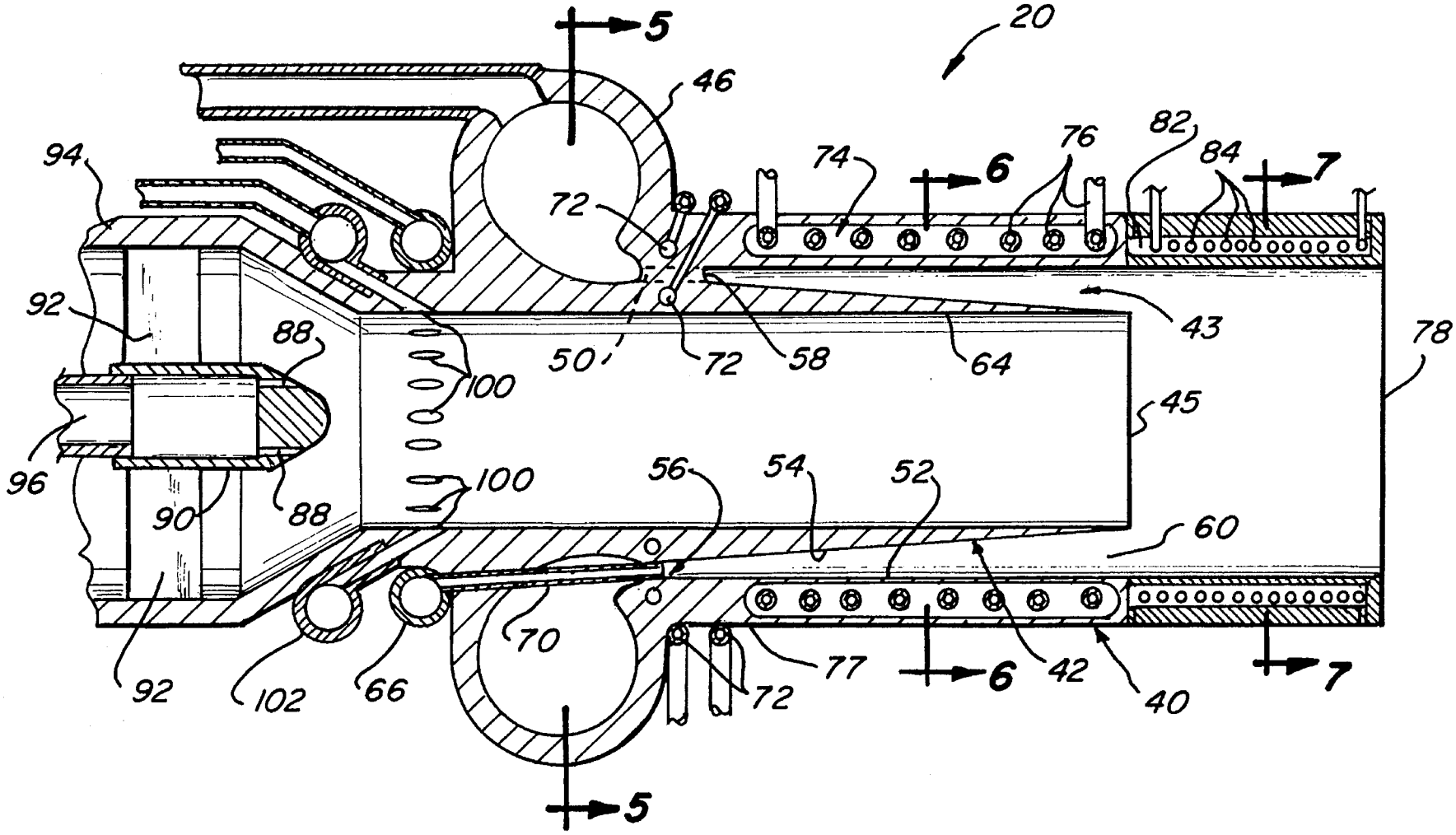
FIG. 4 is an enlarged section taken substantially in the plane of line 4—4 of FIG. 3.

An ice gun 20 capable of projecting both of the ice columns 32 and 34 shown in FIGS. 1 and 2 is illustrated in FIGS. 3 and 4. The ice gun 20 comprises an outer nozzle 40 for projecting a hollow tubular column of encasement material. Although ice is used as the encasement material in the preferred embodiment, and the apparatus 20 is generally referred to as an ice gun, those skilled in the art may use other suitable materials to form the encasement column, provided that the encasement material is capable of transmitting core confinement forces as well as applied forces through the column.

Figure 9B:
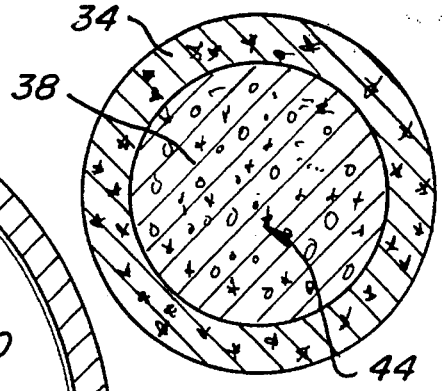
FIG. 9B is an enlarged section taken substantially in the plane of line 9B—9B of FIG. 2.
Figure 9A:
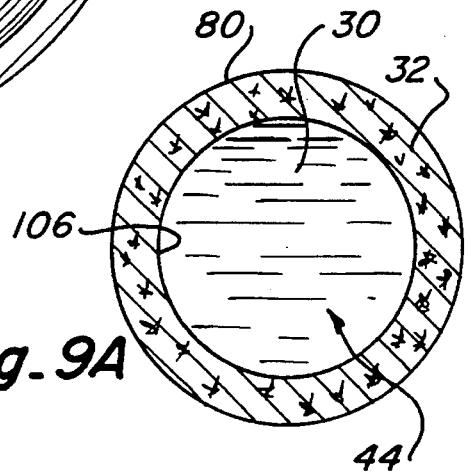
FIG. 9A is an enlarged section taken substantially in the plane of line 9A—9A of FIG. 1.

As best seen in the schematic representation in FIG. 4, the ice gun 20 also includes an inner nozzle 42, coaxial with the outer nozzle 40. The outer and inner nozzles 40 and 42 define a tapered crystallization chamber 43 therebetween in which the hollow encasement column is formed and from which it extends. Thus, the encasement column formed by the ice gun 20 has an internal cavity 44 (FIGS. 8 and 9) of circular cross-section with an internal diameter equal to a diameter of the inner nozzle 42 at an open tip 45 thereof. Core material projected through the inner nozzle 42 fills the cavity 44 so that the core material is encased or laterally confined by the column of encasement material.

Figure 5:
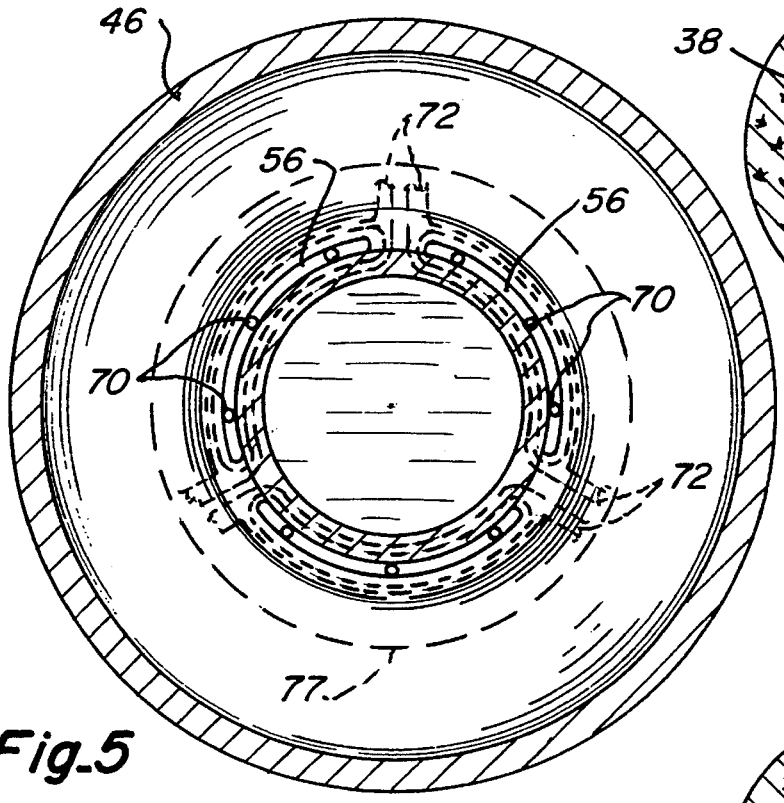
FIG. 5 is an enlarged section taken substantially in the plane of line 5—5 of FIG. 4.

A first high pressure manifold 46 is located at one end of the outer nozzle 40 and maintains a supply of encasement material 48 which, for the ice gun 20, is preferably water in a supercooled state. A plurality of circumferentially spaced, radially extending ribs 50 (three are shown in FIG. 5) extend between an inner surface 52 of the outer nozzle 40 and an outer surface 54 of the inner nozzle 42 to maintain the inner nozzle 42 coaxial with the outer nozzle 40. The ribs 50 define orifices 56 therebetween leading from the first manifold 46 to a trailing end 58 of the tapered crystallization chamber 43. The crystallization chamber 43 is tapered to diverge from the relatively narrow trailing end 58 to a wider leading end 60 at the open tip 45 of the inner nozzle 42, and is formed by tapering the outer surface 54 of the inner nozzle 42 between the trailing and second ends 58 and 60 respectively, as shown in FIG. 4. An inner surface 64 of the inner nozzle 42 is not tapered and thus provides a uniform conduit for core material flow. The tapered crystallization chamber 43 allows the high pressure supercooled water 48 within the first manifold 46 to expand as it solidifies and moves toward the leading end 60 of the crystallization chamber 43.

A second high pressure manifold 66 contains an encasement additive 68 preferably comprising a slurry of ice particles which act as crystallization triggers for the supercooled water 48. Additive tubes 70 from the second manifold 66 extend through the first manifold 46 and into the orifices 56 to mix the encasement additive 68 with the supercooled water 48 as the water is expelled from the first manifold 46 through the orifices 56 and into the crystallization chamber 43. The encasement additive 68 form ice crystal nuclei which enhance the phase change of the supercooled water 48 to ice as the pressurized mixture expands and accelerates from the trailing end 58 toward the leading end 60 of the tapered crystallization chamber 43.

Figure 6:
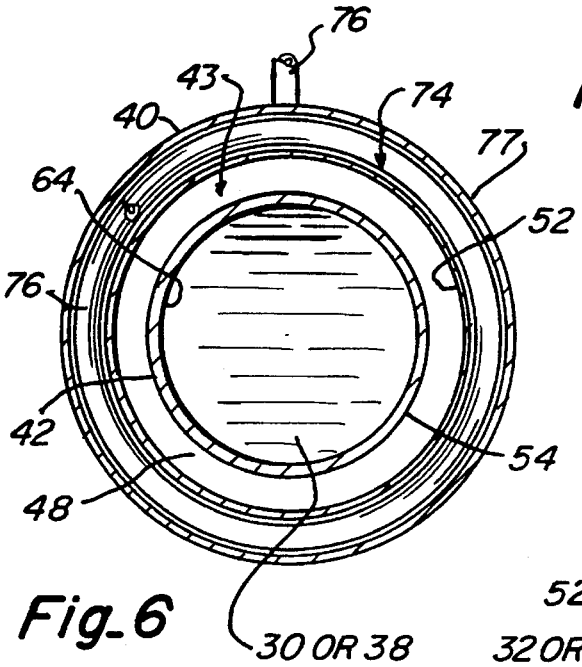
FIG. 6 is a section taken substantially in the plane of line 6—6 of FIG. 4.

Ice formation within the crystallization chamber 43 is further enhanced by cooling the orifices 56 at the trailing end 58 of the crystallization chamber 43. Coolant lines 72 extend through the outer nozzle 40, the ribs 50 and the inner nozzle 42 and encircle each of the orifices 56 as shown in FIGS. 4 and 5. Additionally, the inner surface 52 of the outer nozzle 40 between the trailing and leading ends 58 and 60 respectively of the crystallization chamber 43 is cooled by a cooling jacket 74 in the outer nozzle 40. The cooling jacket 74 utilizes refrigeration coils 76 positioned between the inner surface 52 and an outer surface 77 of the outer nozzle 40, as shown in FIGS. 4 and 6.

As the ice column generated within the crystallization chamber 43 advances toward a muzzle 78 of the ice gun 20, the column merges with and encases the core material at the leading end 60 of the crystallization chamber 43 as the core material is pumped through the inner nozzle 42. As shown in FIGS. 1 and 2 and as mentioned previously, the core material and the ice column may be projected from the ice gun 20 at the same speed or at substantially different speeds.

With respect to the ice gun application shown in FIG. 1, the hollow ice column 32 and the water core 30 are projected from a muzzle 78 of the ice gun 20 with the same velocity. Thus, the water core 30 remains encased within the ice column 32 along their entire trajectory which may extend hundreds of feet high. However, a unitary ice column cannot extend hundreds of feet high due to its inability to support itself. Thus, as shown in FIG. 1, individual columns 32 of ice (each filled with a water core 30) are projected one after another, with an air gap between successive launches to prevent the ice columns 32 from colliding with one another in flight. These individual ice columns 32 are capable of transmitting forces through the entire column, including hoop tension to confine the water core 30 and prevent it from dissipating during flight. However, projecting ice columns hundreds of feet into the air requires a muzzle velocity of hundreds of feet per second. Thus, to project the ice columns 32 shown in FIG. 1, the ice gun 20 must operate in a slightly different manner than when projecting the ice column 34 shown in FIG. 2.

Figure 7:
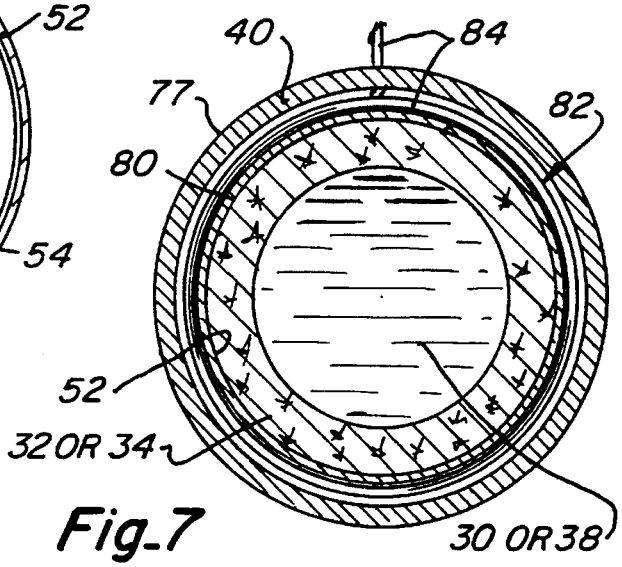
FIG. 7 is a section taken substantially in the plane of line 7—7 of FIG. 4.

First, the long ice columns 32 will experience a significant amount of parasite or skin drag along their entire length. To reduce this drag, an exterior skin 80 of the ice column 32 is heated quickly to polish the skin 80 as the column is projected from the muzzle 78. A hot shoe 82 at the muzzle 78 (FIGS. 4 and 7) heats the exterior skin 80 after formation of the ice lattice within the crystallization chamber 43. The polished surface allows the ice column 32 to slip more easily through the air, thereby providing a more accurate trajectory and reducing the muzzle velocity required for the column to reach the fire scene. The hot shoe 82 utilizes electric heating coils 84 positioned between the inner and outer surfaces 52 and 77 of the outer nozzle 40, as shown in FIGS. 4 and 7.

Next, due to the high velocity of the ice columns 32 and water cores 30, the ram air pressure at the top of each column 32 and the low air pressure immediately behind each column 32 require both ends of the ice column to be sealed to maintain the water core 30 encased within the ice column throughout their entire trajectory. In the preferred embodiment of the ice gun 20 shown in FIGS. 3 and 4, this is accomplished by projecting a solid plug through the inner nozzle 42 at the start and the end of each firing cycle of the ice gun 20 (FIGS. 8A–8D).

The plugs are formed by projecting a plug material 86 such as supercooled water through a plurality of axial injectors 88 positioned within a protective sheath 90 along the common axis of the outer and inner nozzles 40 and 42, as shown in FIGS. 3 and 4. A plurality of circumferentially spaced, radially extending struts 92 (three are shown in FIG. 3) suspend the protective sheath 90 within an expanded bell portion 94 of the inner nozzle 42, while a feed pipe 96 extends through an outer wall of the bell portion 94 to supply the plug material 86 to the axial injectors 88 within the sheath 90. A plug additive material 98 such as a particle slurry is projected from a plurality of angled injectors 100 spaced about the circumference of the inner nozzle 42, as shown in FIG. 4, to supplement the formation of the plug within the inner nozzle 42. A third high pressure manifold 102 maintains the plug additive 98 at a predetermined pressure. In the preferred embodiment shown in FIGS. 8A–8D, the plug material 86 is the same as the encasement material 48 (supercooled water), while the plug additive 98 is the same as the encasement additive 68 (a slurry of ice particles).

Figure 8A:
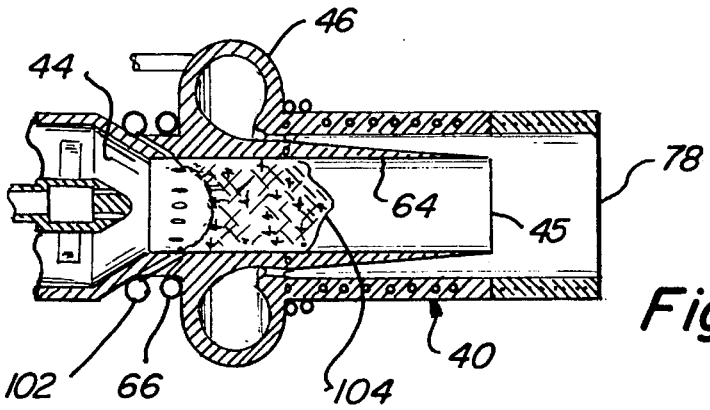
FIGS. 8A–8D are generalized cross-sectional views similar to FIG. 4, showing the operation of the apparatus illustrated in FIG. 1.
Figure 8B:
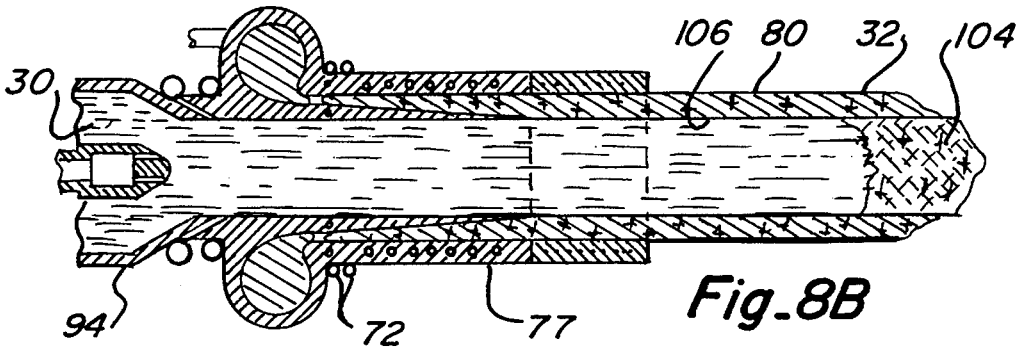
Figure 8C:
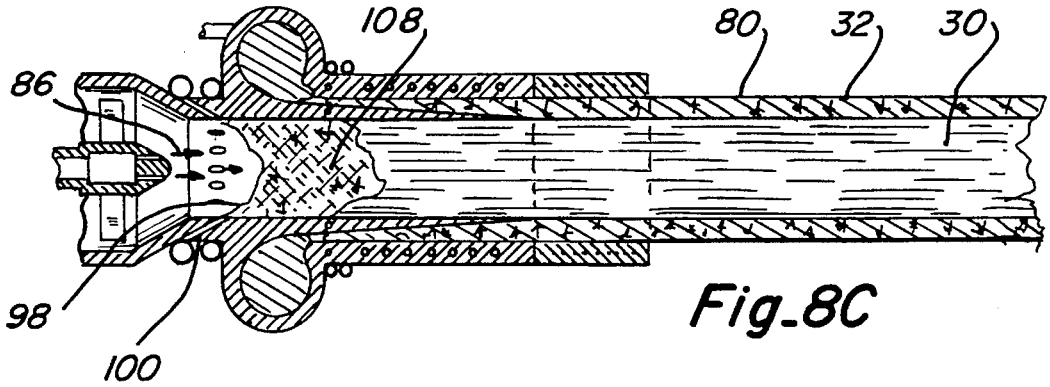
Figure 8D:
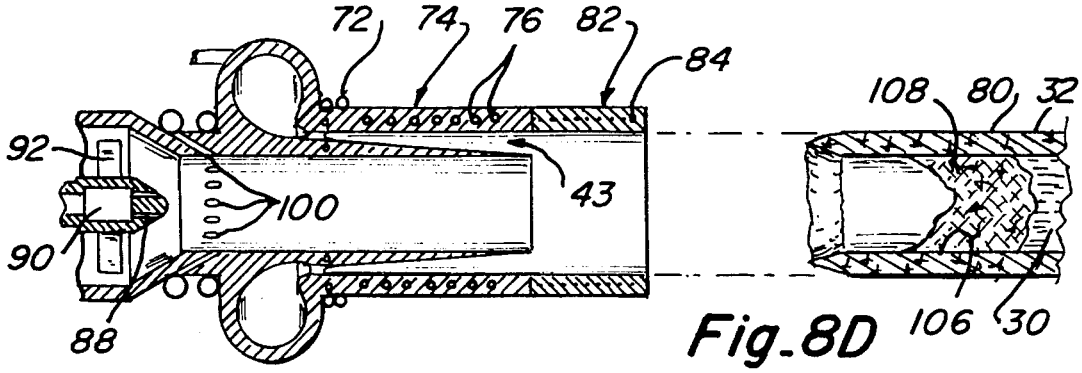

For each firing cycle of the ice gun 20 illustrated in FIG. 1, the projection of the encasement material 48, the core material 30 and the plug material 86 are precisely timed to form a sealed ice column 32 as shown in FIGS. 8A–8D. First, the plug material 86 and the plug additive 98 are projected through the inner nozzle 42 to initiate the formation of a nose plug 104 (FIG. 8A). Next, the encasement material 48 and the encasement additive 68 are projected through the crystallization chamber 43, while simultaneously the pressurized core material 30 is pumped through the inner nozzle 42 past the protective sheath 90 in the bell portion 94 (FIGS. 8A and 8B). The above sequence is timed so that the nose plug 104 merges with the top of the ice column at the open tip 45 of the inner nozzle 42 as the core material 30 fills in the cavity 44 behind the nose plug 104. Due to the turbulent nature of the merger of the plug material 86 and the plug additive 98, the plug does not completely solidify prior to reaching the leading end 60 of the crystallization chamber 43. Thus, the nose plug 104 tends to freeze to an inner surface 106 of the ice column 32 as they merge, thereby forming a rigid nose piece at the top of the ice column (FIG. 8B). Following a predetermined interval, the core material flow is terminated and additional plug material 86 and plug additive 98 are immediately projected toward the muzzle 78 of the ice gun 20 to form a tail plug 108 (FIG. 8C). Once the tail plug 108 has passed the open tip 45 of the inner nozzle 42 and merged with the inner surface 106 of the ice column 32, generation of the ice column 32 is discontinued by first terminating the flow of the encasement additive 68 and then the flow of the encasement material 48 itself. This staggered termination allows the encasement material 48 (supercooled water) to flush the crystallization chamber 43 and thereby prevent ice from forming and creating blockages in the crystallization chamber 43 during the interval between successive firings of the ice gun 20. Similarly, following the formation of the tail plug 108, the flow of plug additive 98 is terminated so that the plug material 86 (supercooled water) may flush out the inner nozzle 42 (FIG. 8D). Additionally, the continued projection of the encasement material 48 and the plug material 86 prevent the departing ice column 32 and tail plug 108 from forming a vacuum within the outer and inner nozzles 40 and 42. Once the ice column 32 has cleared the muzzle 78 of the ice gun 20, the flow of encasement and plug material 48 and 86 is terminated. Next, following a predetermined interval to allow for proper spacing of the ice columns 32, the cycle begins anew.

Although the sealed ice column 32 effectively encases the core material 30, the flight path of the sealed column may still be affected by external forces such as wind. Additionally, the ice column 32 may not be precisely uniform in shape which could cause the column to become unstable during its ballistic flight. In order to stabilize the individual columns 32 and improve the accuracy of the ice gun 20, the ribs 50 which define the orifices 56 leading to the crystallization chamber 43 are preferably angled relative to the longitudinal axis of the inner and outer nozzles to impart a circular motion to the encasement material 48 passing through the orifices 56. Furthermore, the additive tubes 70 may be similarly angled within the orifices 56 to impart a circular motion to the trigger particles 68 added to the encasement material 48. The encasement and additive materials 48 and 68 thus rotate about the outer surface 54 of the inner nozzle 42 as they pass through the crystallization chamber 43. Following the formation of the ice lattice within the crystallization chamber 43, the ice column 32 continues to spin about its longitudinal axis as it is projected from the muzzle 78 of the ice gun 20 due to the transmission of torsional forces through the column. The stabilizing spinning motion of the ice column 32 allows the turret 22 shown in FIG. 1 to be aimed in a conventional manner for accurate ballistic delivery of the ice columns 32.

With respect to the ice gun application shown in FIG. 2, the ice column 34 and core material 38 are projected from the muzzle 78 at different velocities. The ice column 34 is projected relatively slowly and is directed toward the fire scene, while the core material 38 is projected through the ice column 34 relatively quickly to extinguish the fire. The ice column 34 shown in FIG. 2 is a cantilevered conduit through which the core material 38 can be accurately applied to the fire scene. Thus, the ice column 34 confines the core material 38 and prevents its dissipation. Additionally, in supporting its own weight and the weight of the core material 38 therein, the cantilevered ice column 34 of FIG. 2 acts as a structural beam and transmits forces along its length. The ice column 34 has sufficient wall strength to withstand additional dynamic forces generated when the ice gun 20 is swiveled on the turret 22 shown in FIG. 2. If the ice column 34 were unable to transmit these forces, the free end of the ice column could not be redirected as necessary to combat the fire. Instead, the ice column 34 would have to be severed from the muzzle 78 of the ice gun 20, the turret 22 repositioned and the ice column 34 regenerated. During this time the core material 38 could not be applied to the fire scene thereby reducing the effectiveness of the ice gun 20.

Thus, the cantilevered ice column 34 must not be generated beyond a predetermined maximum length for a given column diameter, where the maximum length is defined as the length where the ice column 34 would fail or be severed due to excessive loading. Once the ice column 34 in FIG. 2 has been initially generated, the rate of generation of the ice column is slowed to equal the rate at which the ice melts from the heat of the fire at the free end of the column, thereby maintaining a constant column length.

The same ice gun 20 is used to project the different ice columns 32 and 34 shown respectively in FIGS. 1 and 2. However, since the ice column 34 in FIG. 2 is not projected with significant velocity, the ice column does not need to be sealed at its free end nor does it require polishing for aerodynamic benefit. Thus, no core plugs are generated and the electric heating coils 84 within the hot shoe 82 are not energized during the formation of the ice column shown in FIG. 2. However, the portion of the outer nozzle 40 which contains the hot shoe 82 provides additional support for the cantilevered ice column 34.

Any transportable fire-suppressing core material may be projected through the ice column 34 of FIG. 2. Although chilled water 30 (FIG. 9A) was the preferred core material for the application shown in FIG. 1, water may be inappropriate for some types of fires such as the chemical fire shown in FIG. 2. Thus, a fire suppressant foam 38 (FIG. 9B) is the preferred core material for the application shown in FIG. 2.

Conventional firefighting equipment would be ill suited to combat either of the fires shown in FIGS. 1 and 2. An unconfined water stream would dissipate prior to reaching the height shown in FIG. 1. Additionally, a fire at a chemical warehouse such as that shown in FIG. 2 is extremely difficult to battle due to the potential for toxic fumes. Furthermore, it may not be possible to project a water stream through the opening 36 in the warehouse 28 due to the potential for the water stream to dissipate in the face of the expanding combustion gases venting from the warehouse. However, an ice column capable of transmitting forces can push against the escaping gases and thus be projected through the opening 36 to allow the fire fighters to accurately target the fire scene within the warehouse without having to enter the warehouse.

While different core materials were utilized in the two different applications shown in FIGS. 1 and 2, both firefighting applications utilized ice as the preferred encasement material due to the tendency of ice to absorb heat from the fire and thus assist in extinguishing the fire. Furthermore, ice is inexpensive and simple to form and does not need to be cleaned up after the fire is extinguished. However, it should be understood that the present invention encompasses any transportable encasement material that is capable of transmitting confinement forces for the core material as well as applied forces through the column.

The ice gun 20 shown in FIGS. 1–4 is one example of an apparatus using the structural encasement method of the present invention to transport material. A preferred method of transporting material comprises surrounding a core material, either partially or totally, with an encasement material at a first point and projecting the assembly from the first point to a desired destination. As noted previously, any material may be used to form the encasement provided the material contains structural elements capable of transmitting applied forces through the encasement. Similarly, the core material may comprise any material capable of being transported within the encasement.

The encasement material transmits confining forces to retain the core material in a desired configuration within the encasement. Additionally, vector forces applied to the encasement at the first point are transmitted through the structural elements of the encasement material, within the limits of the structural strength of those elements. These vector forces may be used to direct the assembled encasement and core material to the desired destination.

The method preferably includes the steps of forming a column of encasement material at the first point so that the column defines an internal cavity therein. Next, a core material is projected into the cavity at the first point so that the core material is encased within the column. Forces are applied to the column to direct the column and the encased core material to the desired destination. In one preferred embodiment of the method, the encasement column and the core material are projected ballistically from the first point toward the destination, and thus an additional step of sealing the opposing ends of the column is required to prevent the core material from escaping from the cavity during the ballistic flight of the column.

The method of the present invention transports both the encasement and the core material to the desired destination, regardless of whether the encasement material is required at the final destination. For example, both the ice column 32 and the water core 30 shown in FIG. 1 are useful in combatting a fire. However, one skilled in the art may readily discern potential applications of the method in which the structural material is recycled or simply discarded after delivering the core material to the final destination. Similarly, if only the encasement material is required at the final destination, this material may be transported without the addition of a core material. Alternatively, the encasement and the core materials could constitute the same material. For example, the ice gun 20 shown in FIGS. 1–4 could be used to generate solid columns of ice rather than a hollow column encasing a different core material.

Although the ice gun 20 utilizes a modular method of encasing the core material within the encasement (i.e. surrounding a quantity of core material with an ice column), the core material may be carried in a variety of manners by the encasement. For example, the core material may be mixed with the encasement material to form a homogenous combination, provided that the combination retains sufficient structural strength to transmit forces applied to the combination. Another alternative to modular encasement is to imbed the core material throughout the encasement material. Such a method would be useful in the transport of a solid core material that is not as easily projected as a liquid.

FIGS. 1 and 2 illustrate two different examples of the structural encasement method. FIG. 1 shows an encasement and a core made from the same material (i.e. water) where the encasement material has undergone a phase change to give it the necessary structural strength to transport the core material. Additionally, the ice gun 20 in FIG. 1 demonstrates an encasement and a core material that are transported at the same velocity wherein the encasement completely surrounds and confines the core material. In contrast, the ice gun 20 in FIG. 2 utilizes a core material that is different from the encasement material. Additionally, the core material shown in FIG. 2 travels at a greater velocity than the encasement so that the encasement only partially surrounds the core material.

Aside from the firefighting applications described above, one skilled in the art may apply the method of the present invention to solve numerous problems in the field of material transport. For example, the encasement method of the present invention may be used to transport materials through environments which are not conducive to the transport of materials by conventional means. In addition to transporting materials across voids or through existing pipelines, the encasement may possess sufficient structural strength to transport the core material through any penetrable matter. Furthermore, encasement of the core reduces or eliminates adverse reactions (e.g. contamination of the core material) with the environment through which the core is transported.

Presently preferred embodiments of the present invention have been described with a degree of particularity. These descriptions have been made by way of preferred example and are based on a present understanding of knowledge available regarding the invention. It should be understood, however, that the scope of the present invention is defined by the following claims, and not necessarily by the detailed description of the preferred embodiments.

The invention claimed is:

1. A method of transporting a first material from a first point to a second point, comprising the steps of:

forming a structural encasement of said first material at the first point;

applying force to the encasement at the first point and transmitting the applied force through the encasement; and projecting the encasement from the first point to the second point substantially only as a result of the force applied at the first point.

2. A method as defined in claim 1, further including the step of mixing a core material with the first material prior to forming the encasement at the first point.

3. A method as defined in claim 1, wherein the structural encasement includes an internal cavity, said method further including the step of projecting core material is encased by the first material.

4. A method of transporting material from a first point to a second point, comprising the steps of:

forming a column of encasement material at the first point, said column including an internal cavity;

projecting core material into the cavity of the column at the first point to encase the core material within the encasement material;

applying force to the column at the first point and transmitting the applied force through the column; and projecting the column from the first point to the second point substantially only as a result of the force applied at the first point.

5. A method as defined in claim 4, wherein the core material is different from the encasement material.

6. A method as defined in claim 5, wherein the encasement material is in a solid physical state and the core material is in a non-solid physical state.

7. A method as defined in claim 6, wherein the encasement material is ice.

8. A method as defined in claim 7, wherein the core material is a fire suppressant, and further comprising the step of:

applying the core material and the ice to a fire at the second point to extinguish the fire.

9. A method as defined in claim 4, wherein the core material is the same as the encasement material.

10. A method as defined in claim 9, wherein the encasement material is in a solid physical state and the core material is in a non-solid physical state.

11. A method as defined in claim 10, wherein the encasement material is ice and the core material is water.

12. A method as defined in claim 11, further comprising the step of:

applying the water and the ice to a fire at the second point to extinguish the fire.

13. A method of transporting material from a first point to a second point, comprising the steps of:

forming a column of ice at the first point, said column having a hollow interior;

projecting core material within the hollow interior of the ice column at the first point to encase the core material within the ice column;

applying force to the ice column at the first point and transmitting the applied force through the ice column; and projecting the ice column from the first point to the second point substantially only as a result of the force applied at the first point.

14. A method as defined in claim 13, wherein the ice column and core material are projected ballistically from the first point to the second point, said method further comprising the step of sealing opposing ends of the ice column to prevent the core material from escaping the ice column during the ballistic trajectory of the ice column.

15. A method as defined in claim 14, further comprising the step of applying a force to the ice column at the first point to rotate the ice column about a longitudinal axis of the column to stabilize the ballistic trajectory of the ice column.

16. A method as defined in claim 13, wherein the core material is a fire suppressant, and further comprising the step of:

applying the core material and the ice column to a fire at the second point to extinguish the fire.

17. A method as defined in claim 16, wherein the core material is water.

* * * * *